US005762018A

United States Patent [19]

Huang

[11] Patent Number: 5,762,018

[45] Date of Patent: Jun. 9, 1998

[54] CROSS-SHAPED FISHING FLOAT PLATFORM

[76] Inventor: Wen-Chang Huang, P.O. Box 12097, Taipei, Taiwan

[21] Appl. No.: 749,223

[22] Filed: Nov. 14, 1996

[51] Int. Cl.[6] ..... B63B 35/44

[52] U.S. Cl. ..... 114/267; 405/219

[58] Field of Search ..... 114/258, 263, 114/264, 266, 267; 405/219

[56] References Cited

U.S. PATENT DOCUMENTS

| | | | |
|---|---|---|---|
| 4,260,293 | 4/1981 | Peterson | 114/267 |
| 4,342,277 | 8/1982 | Sluys | 114/293 |
| 4,660,495 | 4/1987 | Thompson | 405/219 |

*Primary Examiner*—Jesus D. Sotelo

*Attorney, Agent, or Firm*—Burns, Doane, Swecker & Mathis, LLP

[57] ABSTRACT

A cross-shaped float platform for use at sea watching and fishing, including 4 long trunk buoys having a plurality of columns connected to form in a cross-shaped float, a structural suspension frame mounted on the columns, decks suspendedly disposed on the lower part of the suspension frame at the middle part of the columns and stretching between the two sides (port and starboard) and along the longitudinal direction, a central connecting member pivotedly connected to each of the buoys, reinforcing elements provided at each connecting portion of the buoys, and a sun canopy mounted on the suspension frame for covering the deck. The cross-shaped fishing float platform can be separated out from the connecting member and folded up to form a dual composite float to facilitate its entry or leave from small harbors or ports.

15 Claims, 4 Drawing Sheets

CROSS-SHAPED FISHING FLOAT PLATFORM

FIELD OF THE INVENTION

The present invention relates to a cross-shaped fishing float platform and, more particularly, to a structure which provides sea or lake fishing lovers with a safe and convenient fishing float platform that can be disengaged and folded, and can be towed along.

Many sea fishing lovers rely on small fishing boats, sampans or small yachts for going out at sea, and when arrived at fishing grounds, they stop engine or release the clutch so that the boat or yacht drifts about to the wind and the fishing lovers use fish hooks with sinkers of 300 g or more in fishing. Generally, because small boat has merely a breadth of 12 ft or 15 ft, the boat will rock on the waves only and when wind and waves become stronger so will be the rocking getting stronger, those fishing lovers who are not accustomed to going out at sea by boat easily get seasick. If in order to reduce rocking by wind and waves, the boat is increased in breadth to 40 ft or more, the manufacture cost of the ship itself would then become astonishing and there would be no profit left.

SUMMARY OF THE INVENTION

Accordingly, the object of the present invention is to provide a cross-shaped fishing float platform, comprising 4 long piece-like cross-shaped buoys having one end narrow and pointed and the other end broad and expanded and provided on the above along the lengthwise direction with a number of spacedly arranged columns; decks supported on each of the columns of the buoys by steel skeleton structural supports and extending along the lengthwise direction; reinforcing elements located at each of the connecting portion of the intersection of the four buoys foldable and pivotable to the buoys by means of hinge; and a sun canopy mounted on the upper part of the cross-shaped center, whereby the entire float platform is rendered insensitive to waves so as to reduce violent rolling and seasickness while, at the same time, the buoys are provided in the inside with ballast tanks to maintain the water displacement line at a specific position and also at the central connecting portions are provided folding hinges or connections so that when typhoon approaches it facilitates towing of the platform into a small harbor for shelter.

BRIEF DESCRIPTION OF THE DRAWINGS

A constructional embodiment of the present invention will now be described, by way of example, with reference to the accompanying drawings, in which.

Figure 1:
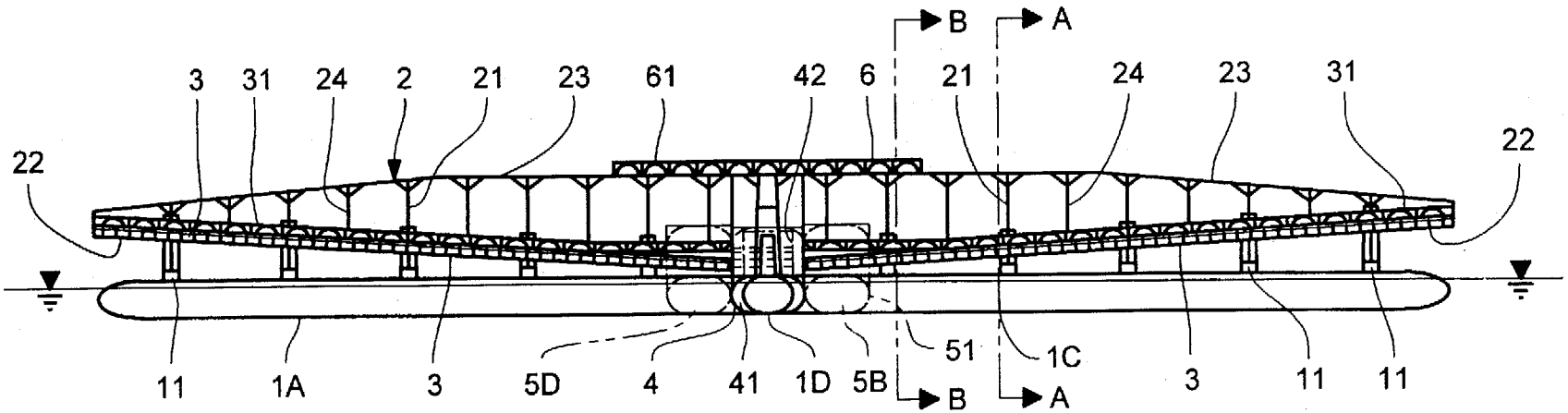
FIG. 1 shows a partial sectional front view of an embodiment of the cross-shaped fishing float platform of the present invention.

DRAWING REFERENCE NUMERALS:

| | |
|---|---|
| 1a, 1b, 1c, 1d | buoys |
| 12 | openings |
| 2 | structural suspension frames |
| 22 | horizontal frame |
| 24 | auxiliary brace |
| 3 | deck |
| 32 | sandwich construction |
| 4 | connecting member |
| 42 | live fish hold |
| 5a, 5b, 5c, 5d | reinforcing elements |
| 6 | sun canopy |
| 11 | hollow column |
| 13 | ballast tank |
| 21 | vertical brace |
| 23 | top beam |
| 25 | steel rope |
| 31 | rail |
| 3a | reserve buoyancy deck |
| 41 | float |
| s1–s4 | screw pivots |
| ha–hd | hinge |
| 61 | rail |

DESCRIPTION OF THE PREFERRED EMBODIMENT

Figure 2:
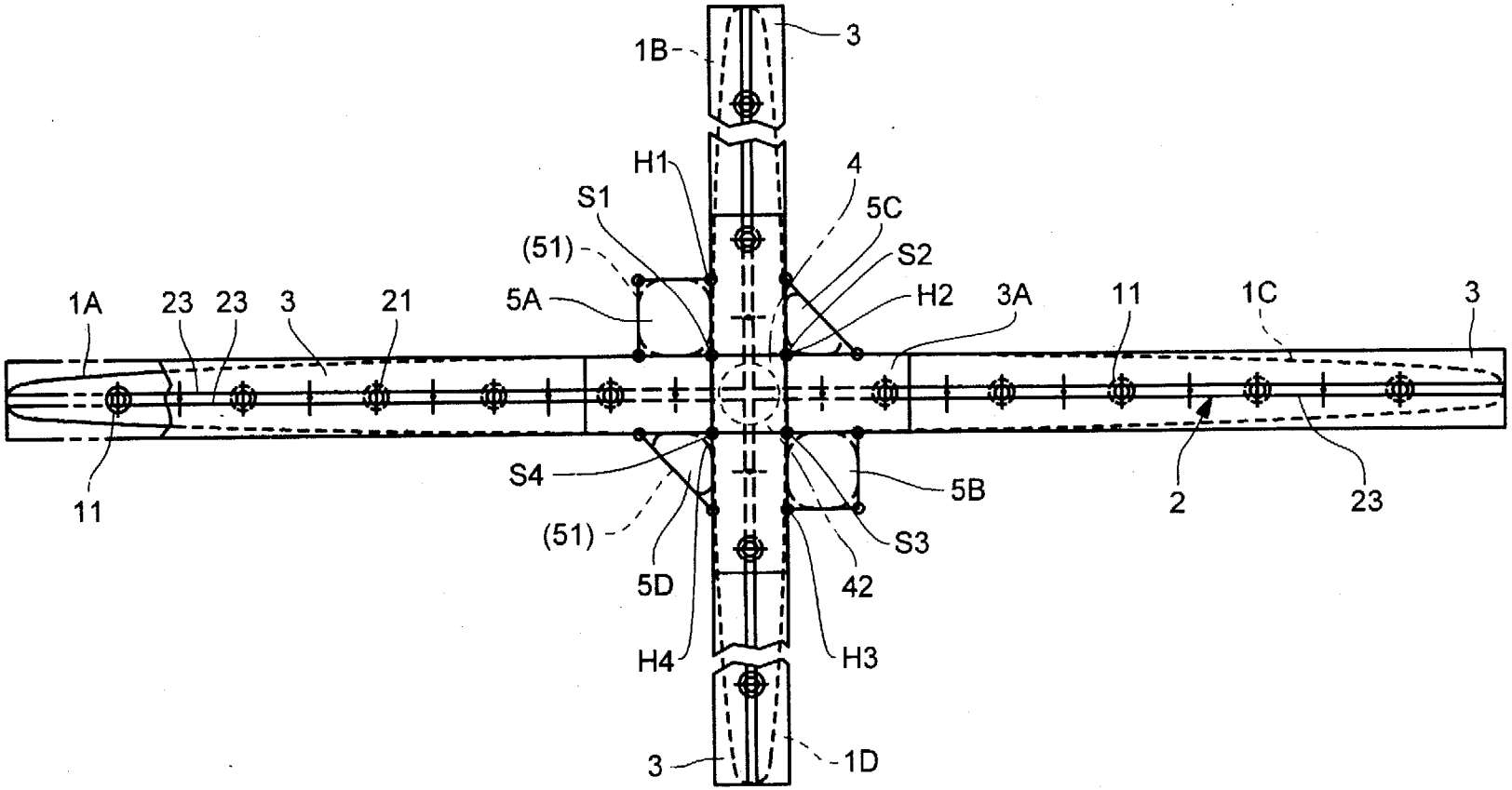
FIG. 2 shows a partial sectional top view of the fishing float platform shown in FIG. 1.

As shown in FIGS. 1 and 2, a fishing float platform of the present invention comprises mainly: four long piece-like buoys 1*a*, 1*b*, 1*c*, 1*d* connected to form in a cross shape; a steel skeleton structural suspension frame 2 mounted on a plurality of hollow columns 11 of the buoys 1*a*–1*d*; decks 3 suspended beneath the suspension frame 2 on the middle part of the column 11; a central connecting member 4 pivotedly connecting each of the buoys 1*a*–1*d*; reinforcing elements 5*a*–5*d* located at the connecting portions of the buoys 1*a*–1*d*; and a sun canopy 6 mounted on the suspension frame 2 of the cross-shaped center.

Figure 3:
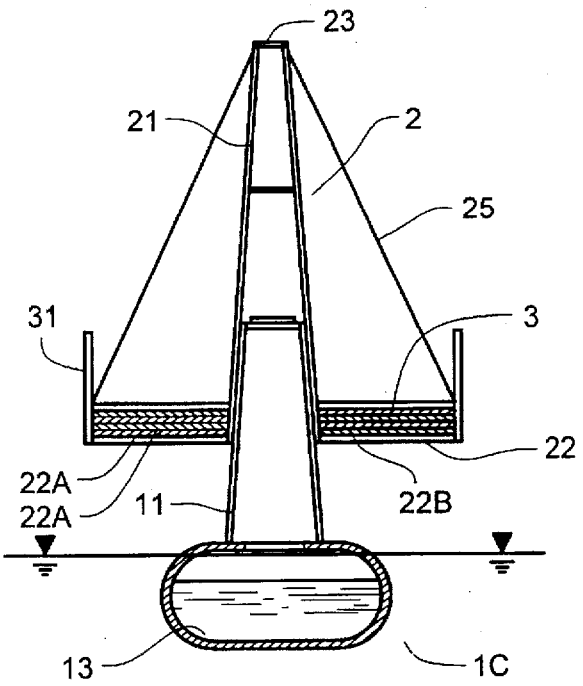
FIG. 3 shows a sectional view taken along line A—A of FIG. 1.
Figure 4:
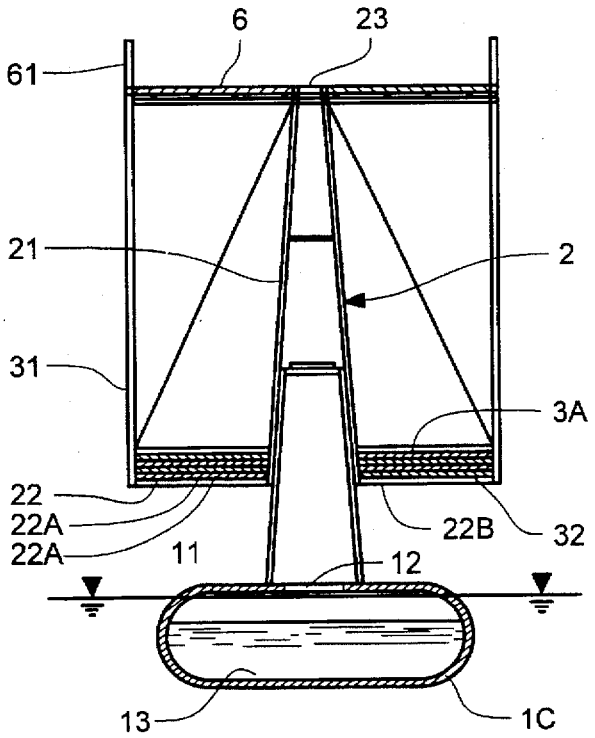
FIG. 4 shows a sectional view taken along line B—B of FIG. 1.

The buoys 1*a*–1*d* are formed into a sealed hollow float having one end round and pointed and the other end broadened, and the two sides (port and starboard) in an arc shape. Along the lengthwise direction of the float on the upper side are mounted at specified intervals a plurality of hollow columns 11, which preferably are pipes of a pier shape being slender on the above and big and thick below or of a pyramid shape, for use in mounting of the suspension frame 2, as shown in FIGS. 3 and 4. These buoys 1*a*–1*d* and the hollow columns 11 can be made by welding of steel sheets or by molding of fiber glass reinforced plastics, or made of composite sheet material of boards or structural steel sheets coated with foam ethylene vinyl acetate (EVA) copolymer or foam rubber. Following from the smaller ends towards the bigger ends of the buoys 1*a*–1*d*, the heights of the columns 11 become more and more shorter and also at the base of the column 11 there is an opening 12 leading to the ballast tank 13 disposed in the interior of the buoys 1*a*–1*d*. To enable entry into the ballast tank 13 for repair and maintenance by person, the entrance at the upper end of the column 11 has an inner diameter, for example, the smallest being 16 ins. and an outer diameter of 18 ins.

The structural suspension frame 2 is mounted on each of the columns 11 of the buoys 1*a*–1*d*, extends along the lengthwise direction and comprises, as shown in FIGS. 3 and 4, a number of vertical braces 21 of a tower steel frame structure fitted over the upper part of each columns 11, a horizontal frame 22 stretching out from the vertical braces 21 towards the sides and along the longitudinal direction and getting higher gradually from the connected end of the buoys 1*a*–1*d* towards the outer end, and a top beam 23 connecting the top of each of the vertical braces 21 and extending along the longitudinal direction. The horizontal frame 22 is a structural body formed by welding of longitudinal and transverse steel beams 22*a*, 22*b*. If distances between the columns 11 are overly large, between the individual braces 21 may still be mounted auxiliary braces 24 having the upper ends connected to the top beam 23 for use to provide support to the horizontal frame 22. In place of these auxiliary braces 24, a steel rope 25 having the upper end tied to the top beam 23 and the lower end hanging obliquely downwardly on the two sides to be pulled at the two sides of the horizontal frame 22, as shown in FIG. 3, may also be used.

The decks 3 are laid on the above of the horizontal frame 22 with the parts located at the bulky ends (that is, the connected ends) of the buoys 1*a*–1*d* to be lower from the water line whereas the parts located at the slender ends (that is, the free ends) to be higher from the water line. In one embodiment of the present invention, the bulky end is about 2 ft. from the water line and the slender end is 6 to 10 ft. from the water line. For decks 3, FRP sandwich constructions or boards may be used which are nailed to the horizontal frame 22, or steel plates which are fixed to the horizontal frame 22, and on all sides there is provided a rail 31 about 80 cms in height as the protective rail. In addition, the parts of the decks 3, which are located at the bulky ends of the buoys 1*a*–1*d*, may be thickened by means of foam resin or boards or FRP sandwich constructions 32 to form a reserve buoyancy deck 3*a* with the upper surface being slightly horizontal (as shown in FIGS. 1 and 4). With this reserve buoyancy deck 3*a*, even when all of the ballast tanks of the buoys 1*a*–1*d* were broken the float platform will still be held in floating on the water by this buoyancy action.

The components of the buoys 1*a*–1*d* having the columns 11 mounted with suspension frames 2 and decks 3 are connected oppositely by the bulky ends thereof under the steel structure in the center on all sides of an essentially square connecting member 4 having a buoy 41 and form a cross-shaped connection body. The square connecting member 4 in the center, however, can also be an extension part of any one of the above buoys 1*a*–1*d*. All four angles of the square connecting member 4 are provided with pivot joints for joining together with the components of the buoys 1*a*–1*d* and are thereby pivotedly connected to the corresponding pivot joints provided at each of the connecting ends of the buoys 1*a*–1*d* by four screw piovts s1–s4 passing the pivot joints to form a foldable disengageable structure. In another embodiment, the connecting member 4 can be a construction having a round cylindrical type steel structure body on the above of a float 41 of an essentially square shape in plane. In the present embodiment, because the connecting member 4 is fixed to the connecting end of the buoy 1*c* component to act as its extension part, hence only the buoys 1*a*, 1*b* and 1*d* are pivotably connected to be foldable and disengageable with relation to the connecting member 4. In order to fully utilize the spaces of this connecting member 4, that portion may be used to form a live fish hold 42 to provide for fishing and fish rearing by personnel from the float platform during slack season.

Figure 5:
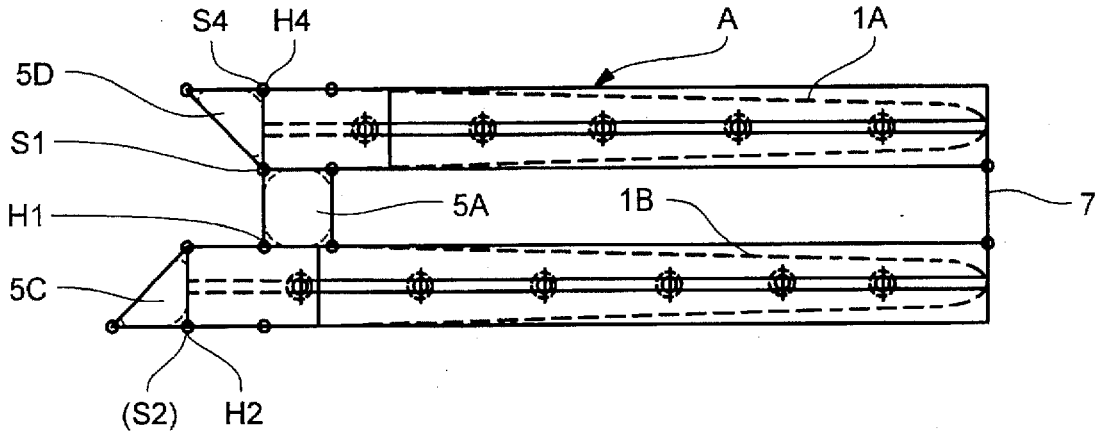
FIGS. 5 and 6 show respectively schematic views of a dual composite float platform A and B formed by disassembling the cross-shaped fishing float platform into two parts, which are folded and connected to each other.
Figure 6:
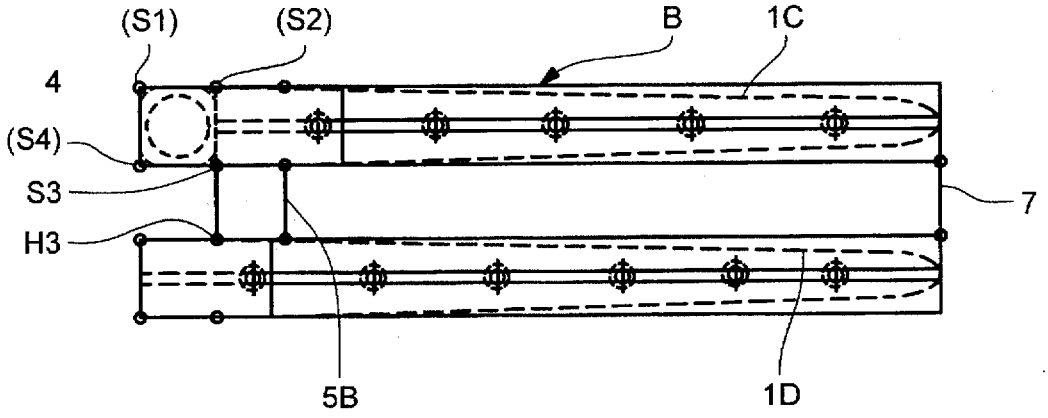

To render the structure of the cross-shaped float platform to be more stout after connection, four reinforcing elements 5*a*–5*d* having, beneath the square and/or triangular steel structure, buoys 51 are respectively disposed at the four joining portions, and in the present embodiment, respectively on the two sets of opposite angles two square reinforcing elements 5*a*, 5*b* and two triangular reinforcing elements 5*c*, 5*d* are used. It is, however, possible if all of the four elements 5*a*–5*d* use the square type or the triangular ones, or any combination of the two types. Further, in the present embodiment in order to make easier the disengagement and the folding of the structure to form a dual composite float platform, as shown in FIGS. 5 and 6, so as to facilitate its entry to and out of the the small harbors thereby accomplishing the objects of sea going procedure and entering harbors for shelter against wind and waves and for mooring, there is at least one place ha–hd on each of the reinforcing elements 5*a*–5*d* which is pivotedly connected to the related float component 1*a*–1*d* and which is a hinge part of a foldable structure, while the rest of the connecting places which may be the disconnected screw-fastening type or hinge-joint type, or even the fixed type.

The sun canopy 6 is mounted on the structural suspension frame 2 above the deck 3 of the central portion of the cross-shaped float platform to provide spaces for fishing lovers to take a rest or chat or to have a drink on decks 3 under the canopy, or spaces for the stewards' sleepers or for refrigerators to store food and drinks. On the circumference on top of this canopy 6 there is also mounted a rail 61 acting as a second deck on the top to provide for fishing lovers to scan the distance and also to fish.

In a specific embodiment, the cross-shaped float platform can be, for example, a length of (1*a*+4+1*c*)×a breadth from 60 ft to 190 ft×4 ft to 6 ft, length of (1*b*+4+1*d*)×breadth from 40 ft to 100 ft×4 ft to 6 ft, and the height/length ratio can be from 1:8 to 1:16. Generally speaking, the height/length ratio of a wooden or FRP-manufactured float platform is 1:8, and for a steel structure weld made float platform it can be 1:16. Now, assuming that the height of the buoys 1*a*–1*d* is 3 ft, the height from the bottom of the column 11 to the deck 3 is 2 ft, the height from the deck 3 to the canopy 6 is 6.5 ft with the total height being about 11.5 ft, then, the longest a steel structure float platform can reach is 184 ft and the longest a FRP-made or wooden float platform can be is 92 ft. In this way, the float platform of the present invention can maintain a considerably sufficient and stable buoyancy and center of gravity. Particularly, since the buoys 1*a*–1*d* are provided in the inside with ballast tanks, it is therefore no matter of how much personnel and fish caught to be carried, a water line can be maintained constantly at the neighborhood of the surface of contact between the columns 11 and the buoys 1*a*–1*d*, as shown in FIG. 1, by ballasts. A very stable fishing float platform can thus be obtained and there can be an reduction of more than 70% in the rolling compared to the common small fishing vessels. Since it is less affected by waves, as a result the fishing time can be increased. Of course, the foregoing description merely illustrates one example of the embodiment. In fact, depending on the surroundings of the fishing grounds, the personnel carrying capicity and the various set conditions, it is possible to select an appropriate ratio of length, breadth and height and it requires only if the stability of center of gravity of buoyancy can be maintained.

The condition on use of the fishing float platform of the present invention constituted above will be described as follows:

Ordinarily, when the float platform is moored at a small harbor and a wharf, it is disengaged and separated into two parts A and B. After each pair of buoys folded together in a right angle, for example, 1*a*, 1*b* and 1*c*, 1*d*, and the reinforcing elements 5*c*, 5*d* are respectively rotated 90 degree with h1–h4 as pivots, tail ends of each pair of the buoys 1*a*, 1*b* and 1*c*, 1*d* are connected by connecting rods or the connecting rope. Also, the reinforcing elements 5*c*, 5*d* are fixed respectively by screw rods (not shown) to the front ends of the buoys 1*a*, 1*b* so that the two pairs of buoys 1*a*, 1*b* and 1*c*, 1*d* are formed in parallel series as shown in FIGS. 5 and 6 to facilitate tugging or berthing at docks. When going out to sea, the two composite floats A and B are towed out of the port by a small boat. After an appropriate fishing ground is selected, the connecting rods 7 and screw rods are disengaged, the two composite floats A and B are stretched out and again with the connecting member 4 as the center are joined together by pivot screws to form the large cross-shaped float platform as shown in FIG. 2. After anchoring at a place the float platform is ready to provide for fishing, sea watching or for relaxation by anglers. If a power generator is provided on the boat, then by leading a cable line from the boat to the fishing float platform it is possible to provide a source of electricity for other services.

The cross-shaped fishing float platform according to the present invention has the following features and advantages:

1. Having the fishing float platform constructed in a cross shape, there is an increase in the length of deck for fishing and also the capacity to resist waves, and while rolling is reduced there is an increase in stability.

2. The steel structure suspension frame is mounted on columns of the buoys and joined together forming a single body and by way of suspension supporting the decks. Also, the central part is formed of a square construction in section to increase the joint face of the steel frame in each of the buoys. The entire construction is thus quite rigid and strong and also convenient for fishing.

3. The cross-shaped float is provided with ballast tanks to maintain a specified level of the water line and this will not change on account of persons or the amount of fish caught, and is thus capable of keeping the float platform insensitive to waves.

4. The cross-shaped float is formed in a rounded trunk in section having the terminal ends round and small and the center bulky and is insensitive to waves coming from four sides thereby enabling it to acquire a stability characteristic.

5. The cross-shaped float platform can be dismantled and folded into two parts forming a dual composite float platform of small breadth to facilitate towing into a small harbor to take shelter against wind or berthing at docks before any typhoon comes.

Although the invention has been described in detail with reference to its presently preferred embodiment, it will be understood therefore that various modifications and changes, for example, to change rationally the sectional form of the buoys and columns, an increase or decrease in the number of the float platforms, to vary the shape of joining, a change in the suspension frame structure, a change in the joining means of the connecting member and each buoys, etc., can be made without departing from the spirit and scope of the invention set forth in the appended claims.

I claim:

1. A cross-shaped fishing float platform comprising:

(a) four long trunk buoys connected at the connecting ends to form a disengageable and foldable float having on the upper side of trunk buoys vertically mounted with a plurality of spacedly arranged columns;

(b) a steel skeleton structural suspension frame mounted on the plurality of columns of said float;

(c) decks suspendedly disposed on the lower part of said structural suspension frame at the middle parts of said columns and stretching along the lengthwise direction of said float;

(d) a central connecting member for use in pivotedly connecting said buoys; and (e) reinforcing elements provided at the connecting portions of the float platform of a cross-shaped connection and having at least one place to be pivotably rotatable.

2. The cross-shaped fishing float platform according to claim 1, wherein said float is formed with long hollow trunk buoys having one end round and pointed and the other end of a connecting end bulky, and the two sides, port and starboard, appearing in arc shape, said hollow trunk buoys having on the upper side along the lengthwise direction thereof spacedly mounted with a plurality of hollow columns.

3. The cross-shaped fishing float platform according to claim 2, wherein the hollow part of each of said buoys forms a ballast tank.

4. The cross-shaped fishing float platform according to claim 2, wherein said structural suspension frame is mounted with a sun canopy extending along the longitudinal direction to cover the entire decks.

5. The cross-shaped fishing float platform according to claim 2, wherein said structural suspension frame includes:

a plurality of tower vertical braces having the lower ends inserted over said columns and the upper ends extending upwardly, a horizontal frame stretching from said vertical braces towards the two sides and along the longitudinal direction and gradually obliquely elevating from the bulky connecting end towards the round and pointed terminal end, and a top beam connecting each of said vertical braces at the upper part and extending along the longitudinal direction.

6. The cross-shaped fishing float platform according to claim 5, wherein the part located at the connecting end of said structural suspension frame is mounted with a sun canopy to cover the decks thereunder.

7. The cross-shaped fishing float platform according to claim 1, wherein said decks are laid on the horizontal frame of said structural suspension frame.

8. The cross-shaped fishing float platform according to claim 7, wherein the parts located at the connected end of said decks are specifically thickened to constitute a reserve buoyancy deck portion.

9. The cross-shaped fishing float platform according to claim 1, wherein said central connecting member is disengageably and foldably connected to the connecting end of each of the buoys by pivoting means, preferably one of which pivoting parts is joined to any one of the four buoys to form a single inseparable body.

10. The cross-shaped fishing float platform according to claim 9, wherein said central connecting member is formed in a steel member having therebeneath a buoy, the interior space of said member also constituting a live fish hold.

11. The cross-shaped fishing float platform according to claim 1, wherein the hollow part of each of said buoys forms a ballast tank.

12. The cross-shaped fishing float platform according to claim 1, wherein the part located at the connecting end of said structural suspension frame is mounted with a sun canopy to cover the decks thereunder.

13. The cross-shaped fishing float platform according to claim 1, wherein said structural suspension frame is mounted with a sun canopy extending along the longitudinal direction to cover the entire decks.

14. The cross-shaped fishing float platform according to claim 1, wherein the parts located at the connected end of said decks are specifically thickened to constitute a reserve buoyancy deck portion.

15. The cross-shaped fishing float platform according to claim 1, wherein said central connecting member is formed in a steel member having therebeneath a buoy, the interior space of said member also constituting a live fish hold.

* * * * *